US005573216A

United States Patent [19]

Kuroda

[11] Patent Number: 5,573,216

[45] Date of Patent: Nov. 12, 1996

[54] BOX HOLDER

[76] Inventor: Akitada Kuroda, 2-13-4 Mitake Togo-cho, Aichi-gun, Aichi-ken, Japan, 470-01

[21] Appl. No.: 207,720

[22] Filed: Mar. 7, 1994

[51] Int. Cl.[6] ..... A47G 1/10

[52] U.S. Cl. ..... 248/316.7; 248/206.5; 248/905; 248/684

[58] Field of Search ..... 248/316.7, 316.2, 248/905, 684, 206.5, 229, 305, 313; 224/42.42, 42.46 R

[56] References Cited

U.S. PATENT DOCUMENTS

| | | | |
|---|---|---|---|
| 2,991,036 | 7/1961 | Morgan et al. | 248/905 X |
| 4,176,817 | 12/1979 | Jones | 248/905 X |
| 4,177,910 | 12/1979 | Gangl | 248/905 X |
| 4,351,505 | 9/1982 | Wickersham | 248/316.7 |
| 5,065,970 | 11/1991 | Gross | 248/316.7 X |

FOREIGN PATENT DOCUMENTS

| | | | |
|---|---|---|---|
| 5132086 | 5/1993 | Japan | 248/905 |
| 1214797 | 12/1970 | United Kingdom | 248/316.7 |

*Primary Examiner*—Ramon O. Ramirez

[57] ABSTRACT

A new box holder comprising of an insert portion which can be inserted into a box through a hole made in one of its bottom or sides, a basis which clips said bottom or side of said box with said insert portion, and an attaching portion fixed to said basis which can be attached to a wall or the like, wherein the space between said insert portion and said basis is wide at the tip of said insert portion and narrow at the nearer part of said insert portion to the root thereof and the side or the bottom of the box can be clipped between said insert portion and said basis.

2 Claims, 7 Drawing Sheets

BOX HOLDER

BACKGROUND OF THE INVENTION

The present invention relates to a box holder for attaching a tissue box, clear-plastic wrap box, foil box or the like, to a wall or the like.

Since the tissue box is troublesome when it is left on the table, a conventional box holder was invented with which the tissue box is attached to a wall. For example, the Japanese Utility Model laid open No. 61-18097(1986) disclosed a box holder consists of a case in which a tissue box can be held and attached to the wall.

But, the conventional box holder is such a large size that a tissue box can be contained. This makes the package large size, and needs much expenses for carrying, storeing and desplaying the goods. When this box holder is attached to the wall, it does not show a good appearance because of its bulkyness. When the tissue box is removed, the box holder protrudes from the wall. This causes inconvenience and spoils the interior appearance.

SUMMARY OF THE INVENTION

An object of the present invention is to provide an improved, simple, compact and inexpensive box holder which eliminates the above mentioned disadvantages. The present invention provides a new box holder comprising:

an insert portion which can be inserted into a box through a hole made in one of its bottom or sides, a basis which clips said bottom or side of said box with said insert portion, and an attaching portion fixed to said basis which can be attached to a wall, wherein the space between said insert portion and said basis is wide at the tip of said insert portion and narrow at the nearer part of said insert portion to the root thereof and the side or the bottom of the box can be clipped between said insert portion and said basis.

The present invention provides another new box holder comprising:

an insert portion which has a cutter at its tip and can be inserted into a box through a hole made in one of its bottom or sides, a basis which clips said bottom or side of said box with said insert portion, and an attaching portion fixed to said basis which can be attached to a wall, wherein the space between said insert portion and said basis is wide around the tip of said insert portion and narrow at the nearer part of said insert portion to the root thereof and the side or the bottom of the box can be clipped between said insert portion and said basis.

Thus, the insert portion can be inserted into the box through a perforated line or a hole cut by the cutter of the insert portion and the sides or the bottom of the box can be clipped between the insert portion and the basis of the box holder. The box holder can be attached to the wall by means of magnetic force, when the attaching portion is made of magnet, together with the box. So the top surface of tables or desks become clean.

PREFERRED EMBODIMENT OF THE INVENTION

Figure 1:
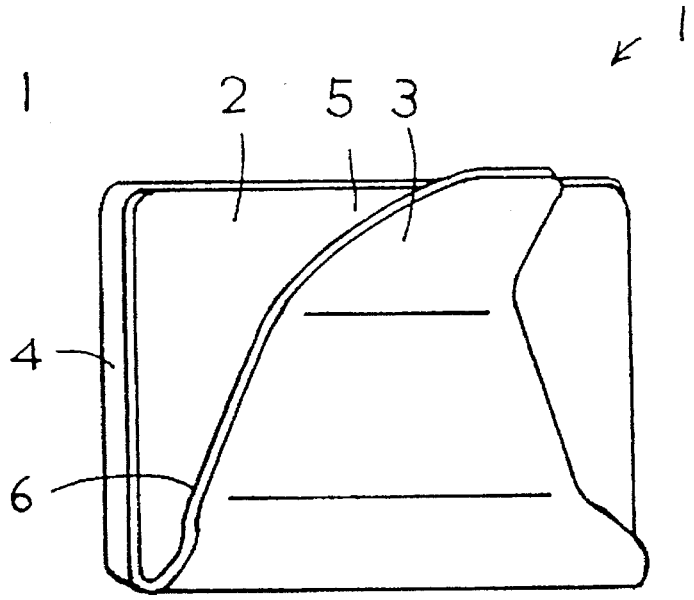
FIG. 1 is a perspective view of a box holder of the first embodiment.

FIG. 1 of the drawing shows the first embodiment of the present invention. A box holder 1 of the present invention is comprised of a basis 2, an insert portion 3 and an attaching portion 4. One end of the insert portion 3 is fixed to the basis 2. In this embodiment, the insert portion and the basis is made integrally by bending a spring sheet. The attaching portion 4 is made from magnet and fixed to the basis 2.

Figure 2:
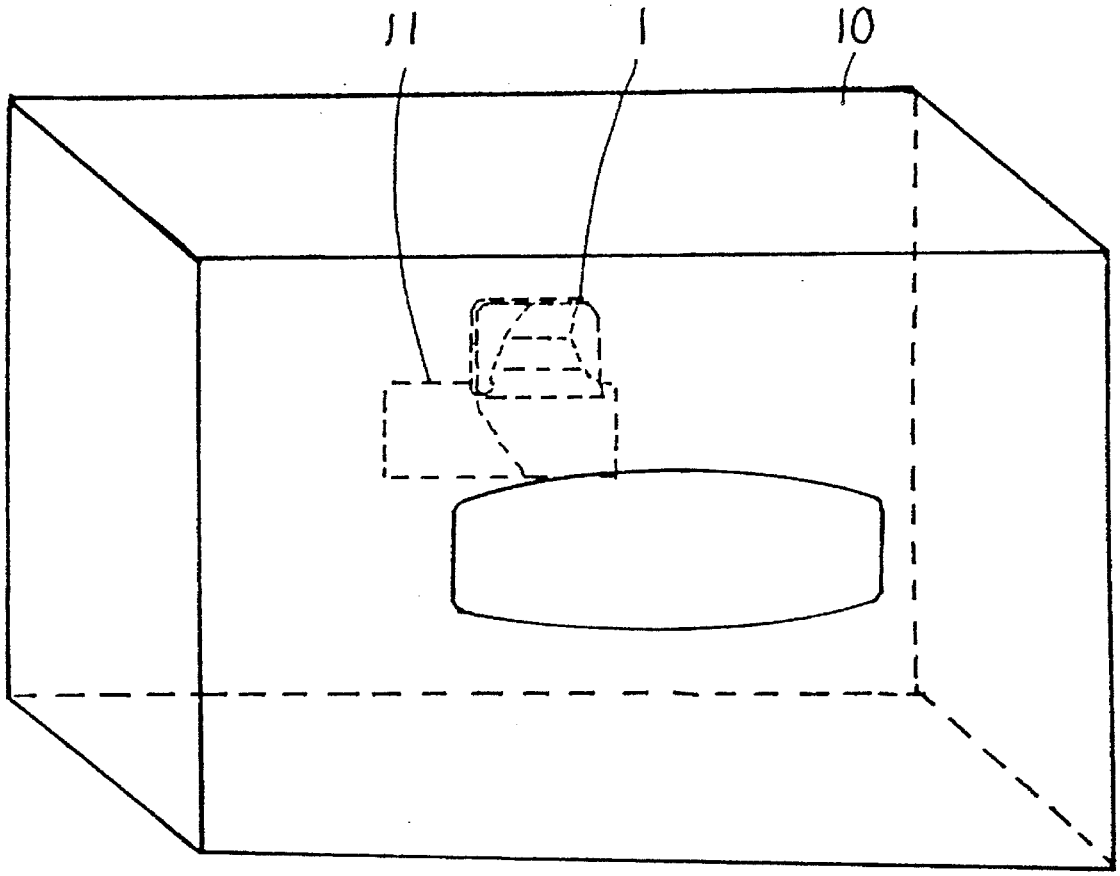
FIG. 2 is a perspective view of the box holder of the first embodiment attached to the wall together with a box.

FIG. 2 shows how to use the box holder 1. The insert portion 3 is inserted into a box 10 through the perforated line 11. The box holder 1 can be attached to a wall by magnetic force together with the box 10.

The space between the insert portion 3 and the basis 2 is wide around the tip of the insert portion (guide 5) and narrow at the nearer part of the insert portion to the root thereof (holding portion 6). The side or the bottom of the box can be inserted into the space through the guide 5 smoothly and be clipped between the insert portion 3 and said basis 2.

In this embodiment, as the insert portion 3 is narrow around the tip thereof, insert portion 3 can be inserted into the box 10 through the perforated line 11 smoothly. As the insert portion 3 is wider at the nearer part to the root thereof, the side or the bottom of the box 10 is clipped firmly.

Since the attaching portion 4 is made from magnet, the box holder 1 can be attached to and removed from the wall smoothly together with the box 10. In the case of conventional box holder, when the box is removed from the wall, the box holder is left and protrudes from the wall. But in the present invention, when the box 10 is removed from the wall, nothing protrudes on the wall and the wall becomes clean.

The box holder of the present invention can be hidden on the back of the box 10, so the appeaance becomes simple and clean.

The limitted size and shape of box can be used to the conventional box holder, but the various size and shape of box can be used to the box holder of the present invention.

Also, adhesive, suction cup, hook or clip can be used as the attaching portion instead of the magnet.

Figure 4:
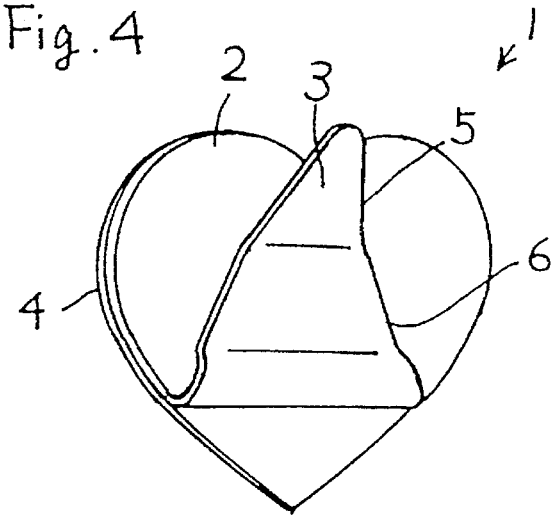
FIG. 4 is a perspective view of a box holder of the third embodiment.

FIG. 4 shows the second embodiment. This box hoder has the two holding portion 6, therefore the box 10 can be clipped more firmly.

Figure 3:
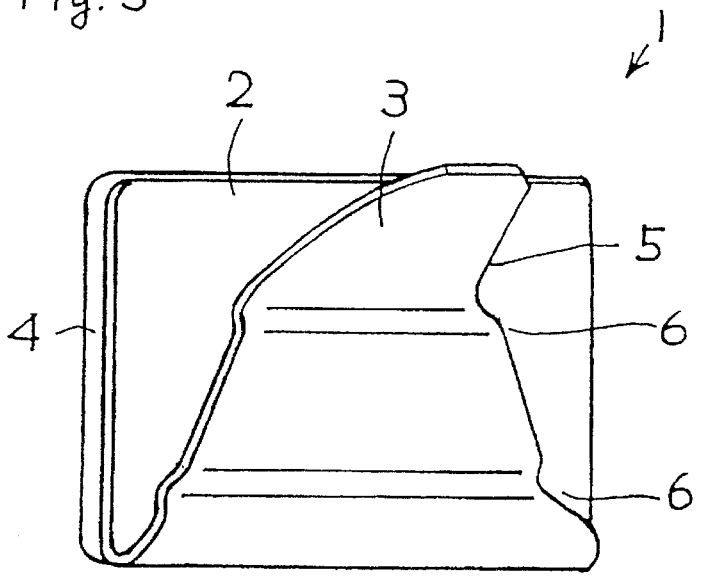
FIG. 3 is a perspective view of a box holder of the second embodiment.

FIG. 3 shows the third embodiment. This box holder has the heart shaped basis.

Figure 5:
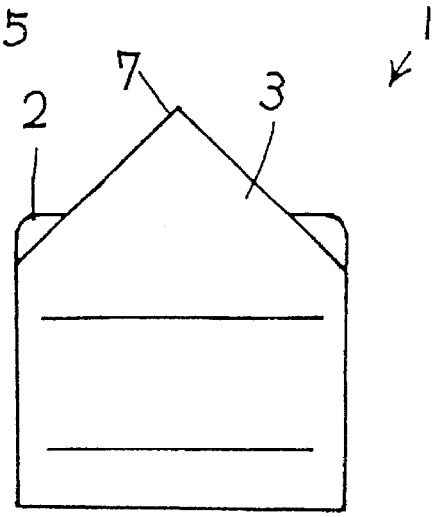
FIG. 5 is a front view of a box holder of the fourth embodiment.

FIG. 5 shows the fourth embodiment. This box holder has a cutter 7 at the tip of the insert portion 3. When the box 10 has no perforating line 11, the cutter 7 can make a hole in the side or the bottom of the box. The insert portion 3 can be inserted into the box by cutting the box 10 and pushing the insert portion 3 into the box 10 with a continuous simple motion.

Figure 6:
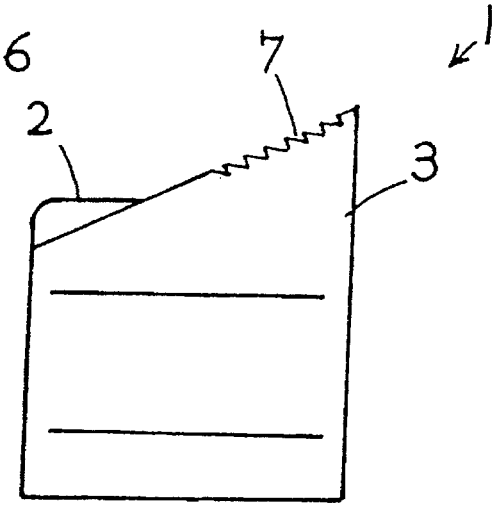
FIG. 6 is a front view of a box holder of the fifth embodiment.

FIG. 6 shows the fifth embodiment. This box holder has a sawteeth cutter 7, this makes the handling safe and smooth.

Figure 7:
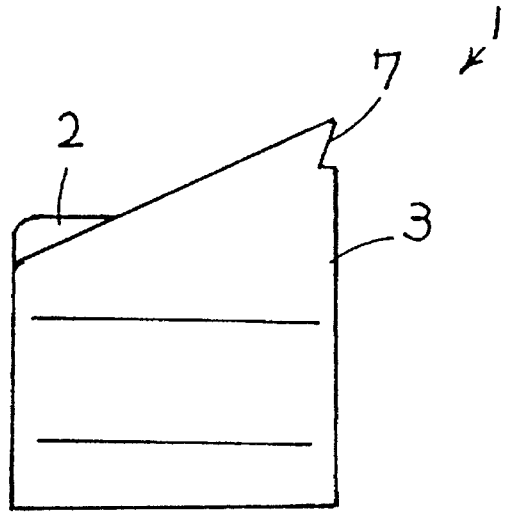
FIG. 7 is a front view of a box holder of the sixth embodiment.

FIG. 7 shows the sixth embodiment. This box holder has the sawteeth cutter 7, in the hidden place, so that fingers do not touch the sawteeth.

Figure 8:
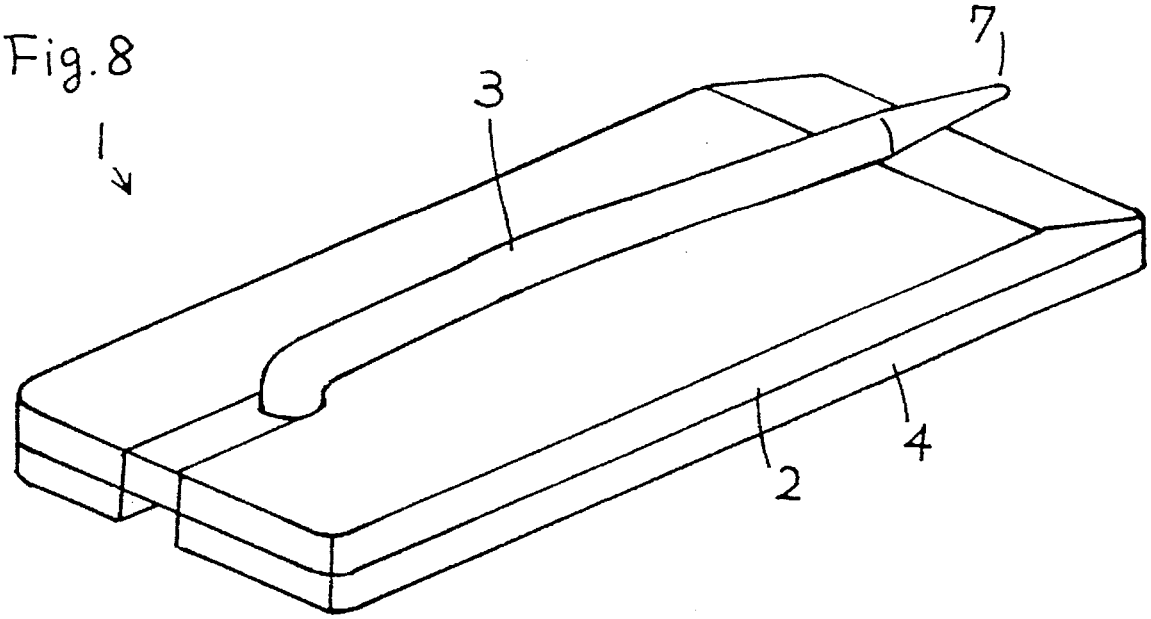
FIG. 8 is a perspective view of a box holder of the seventh embodiment.

FIG. 8 shows the seventh embodiment. This box holder has the stick type insert portion 3 and the cutter 7, this makes smooth insert of the insert portion. The cross section of the insert portion may be round, rectangular, triangular and so on. Also, the insert portion 3 may be tapered. The cutter may not be so sharp like a knife or a needle, it is enough if the cutter can make a hole in the paper or the plastic film and the cutter does not hurt a human body. Eventhough the box holder is placed on a floor and someone stepped on it, the cutter does not hurt the human body, because the cutter lies sideways. As the protruding of the cutter 7 from the edge of the basis 2 is small or minus, this increases safety. In this embodiment, the insert portion 3 is not bent outwardly around the guide 5, as the basis 2 has a slope to form the the guide 5, so that the insert portion 3 is safer.

Figure 9:
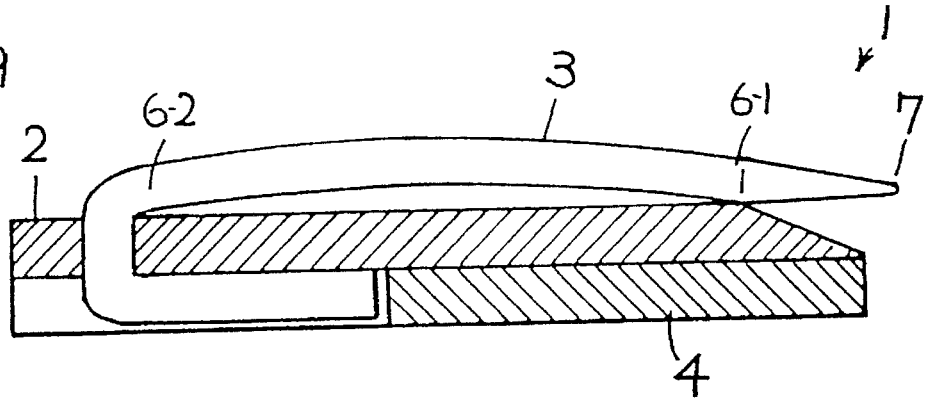
FIG. 9 is a longitudinal section of FIG. 8.

FIG. 9 shows the longitudinal section of the seventh embodiment shown by FIG. 8.

The space between the insert portion 3 and the basis 2 is wide around the tip of the insert portion (guide 5) and narrow at the nearer parts of the insert portion to the root thereof (2 holding portions 6-1,6-2). The space between the insert portion 3 and the basis 2 is a little bit wide at the middle part between 2 holding portions. 6-1, 6-2. Thus the two holding portions 6-1, 6-2 can clip the side or the bottom of box with a wide span and the box can be held firmly.

The width of the basis 2 is narrow near the guide 5. This results in the smooth insert of the insert portion 3 into the box 10, even though the box holder 1 inclines or the bottom or the side of the box 10 dents.

Figure 10:
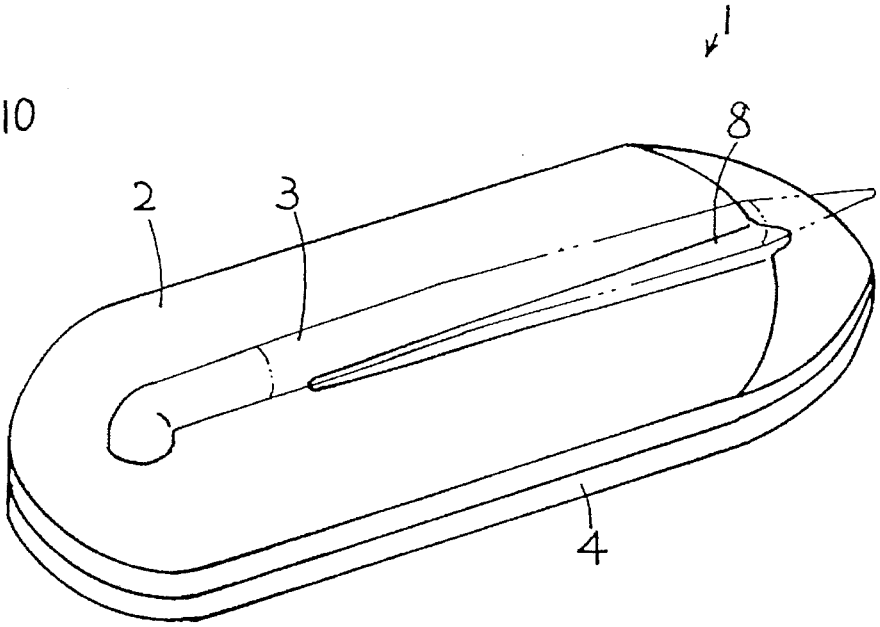
FIG. 10 is a perspective view of a first improved box holder of the seventh embodiment.
Figure 11:
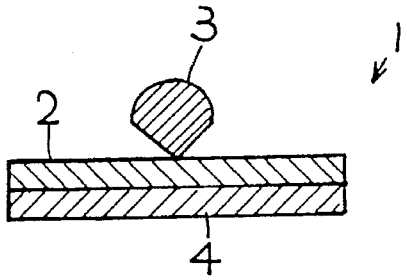
FIG. 11 is a cross section of a second improved box holder of the seventh embodiment.

FIG. 10 shows the improved box holder of the seventh embodiment. This box holder has a groove 8 on the basis 2 along the insert portion 3. The groove 8 prevents the box from slipping sideways without disturbing the insertion of the insert portion 3. There may be also prural grooves 8 or two insert portions 3 in order to increase the stability of holding of the box 10. As shown in FIG. 11, the insert portion 3 may have the edge for the same purpose.

Figure 12:
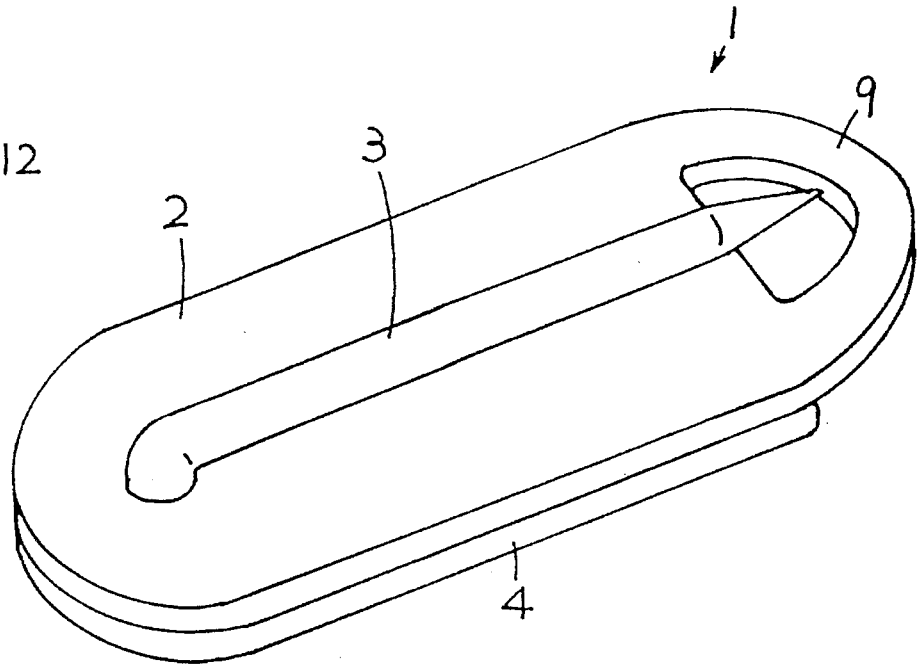
FIG. 12 is a perspective view of a third improved box holder of the seventh embodiment.

As shown in FIG. 12, there may be a protection means 9 which guards the cutter 7, when users feel fears, even though the cutter 7 is not dangerous. Since the protection means 9 is made of resilient material, the cutter 7 can be inserted into the box by bending the protection means 9 when the box holder is pressed to the box.

Figure 13:
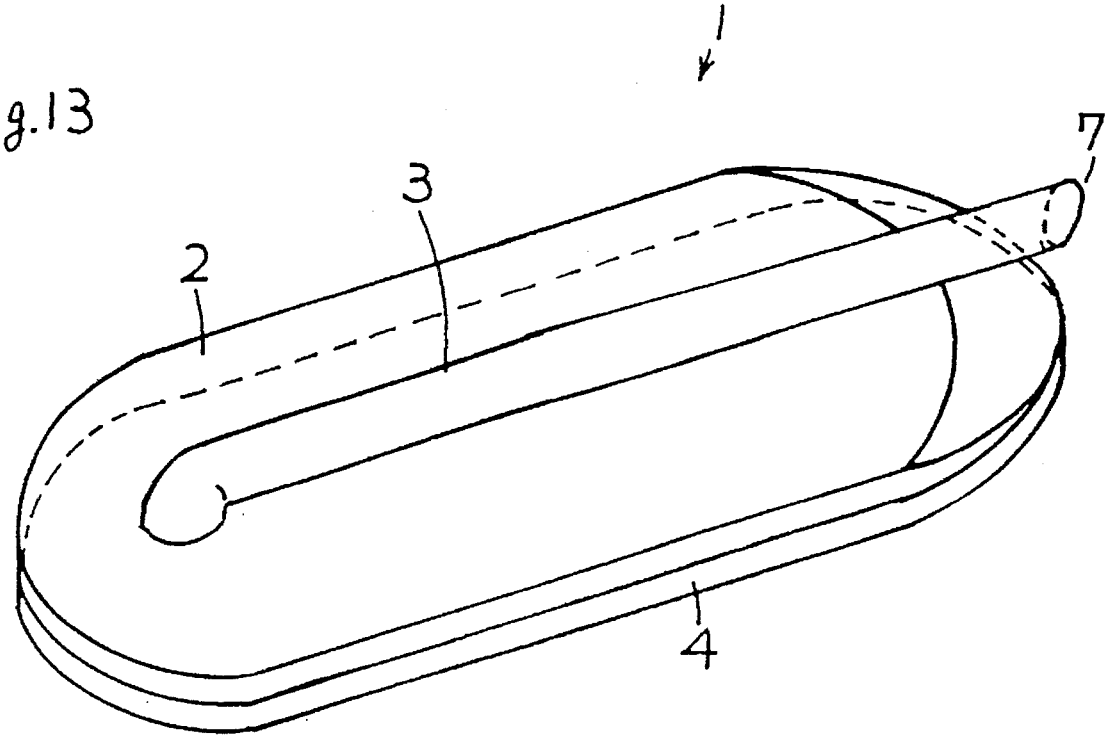
FIG. 13 is a perspective view of a box holder of the eighth embodiment.

FIG. 13 shows the improved cutter 7. This cutter 7 has a substantially flat cut end which slants inwardly. This results in reducing the stress applied to the human body, when the human body is pressed to the cutter 7, because the stress is dispersed as the humann body is flexible and the area of the cut end is large. On the other hand, the box is not so fexible as the human body, the stress concentrates on the small area and makes a hole easily.

Figure 14:
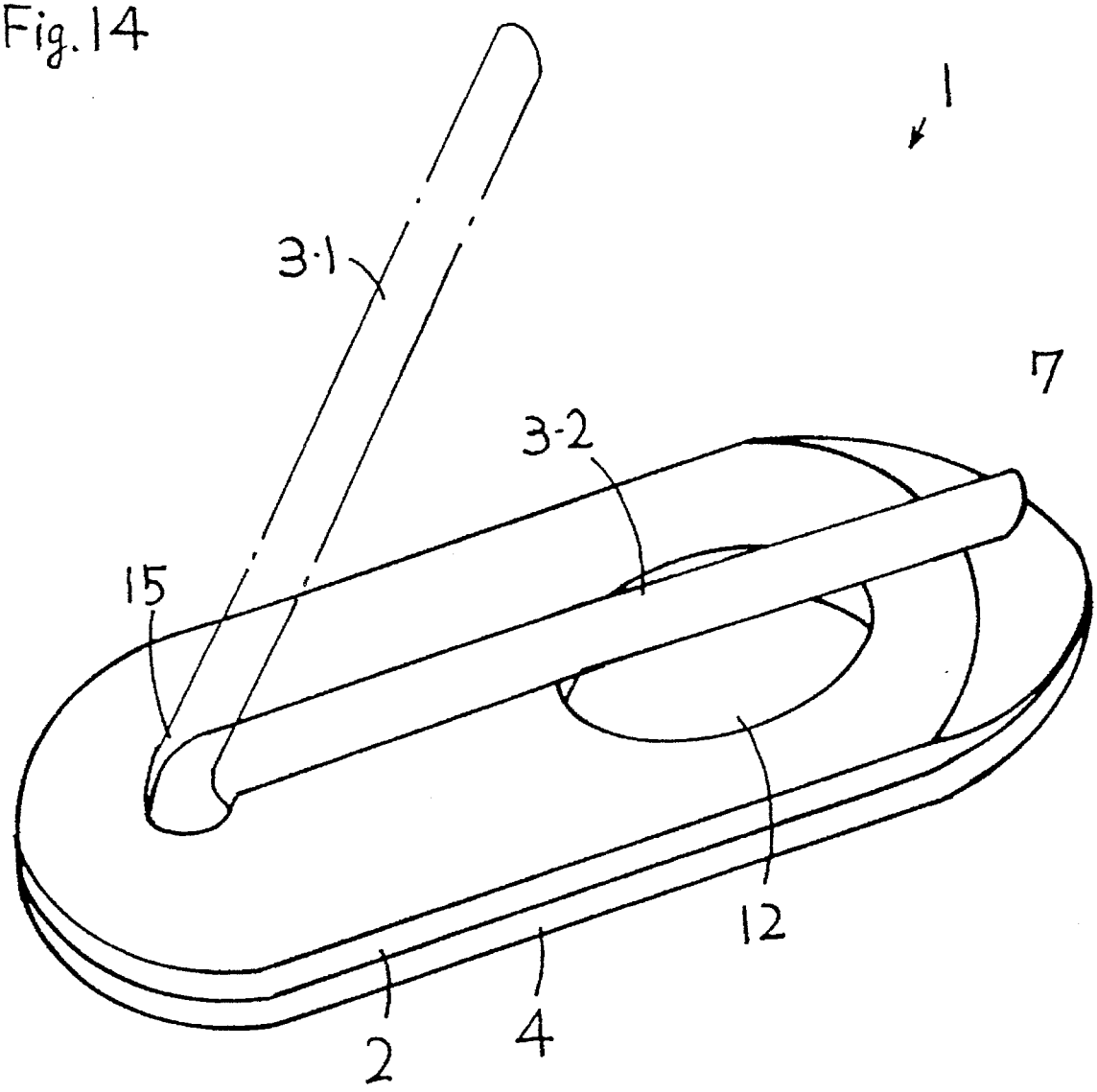
FIG. 14 is a perspective view of a box holder of the nineth embodiment.

FIG. 14 shows the eighth embodiment. This box holder has a hinge 15, around which the insert portion 3 can be erected like 3-1. The insert portion 3 is forced to fall down like 3-2 by spring force. The insert portion 3 can be erected by putting a finger into a hole 12 in the basis 2. This makes easy insertion of the insert portion 3 into the box and increases safe feeling, as the cutter does not protrued from the end of the basis.

What is claimed is:

1. A box holder comprising:

a base having two ends, one of said ends having a slope surface defining a guide means;

an elongated insert portion having an end attached to the base extending towards the slope surface and above the base defining a space between the insert portion and the base, said insert portion having a tip at its end near the slope surface, said tip defining a cutter adapted to be inserted into a box;

and an attaching portion fixed to said base for attaching the base to a wall;

wherein the space between the insert portion and the base is greater near the slope surface than at the attached end such that the box can be clipped between said insert portion and said base.

2. The box holder according to claim 1:

wherein the insert portion is a stick type insert portion.

* * * * *